US006266836B1

(12) United States Patent
Gallego Juarez et al.

(10) Patent No.: US 6,266,836 B1
(45) Date of Patent: Jul. 31, 2001

(54) PROCESS AND DEVICE FOR CONTINUOUS ULTRASONIC WASHING OF TEXTILE

(75) Inventors: Antonio Gallego Juarez; German Rodriguez Corral; Gonzalo Najera Vazquez de Parga; Fernando Vazquez Martinez; Piet van der Vlist, all of Madrid (ES)

(73) Assignee: Consejo Superior de Investigaciones Cientificas, Madrid (ES)

( * ) Notice: Subject to any disclaimer, the term of this patent is extended or adjusted under 35 U.S.C. 154(b) by 0 days.

(21) Appl. No.: 09/284,004

(22) PCT Filed: Oct. 1, 1997

(86) PCT No.: PCT/ES97/00239

§ 371 Date: Dec. 27, 1999

§ 102(e) Date: Dec. 27, 1999

(87) PCT Pub. No.: WO98/15679

PCT Pub. Date: Apr. 16, 1998

(30) Foreign Application Priority Data

Oct. 4, 1996 (ES) ..... 9602092

(51) Int. Cl.[7] ..... D06B 3/00; B08B 3/12

(52) U.S. Cl. ..... 8/151; 8/158; 68/355; 134/1; 134/64 R; 134/122 R

(58) Field of Search ..... 8/151, 158; 68/355; 134/1, 64 R, 122 R; 34/255, 258

(56) References Cited

U.S. PATENT DOCUMENTS

| | | | | |
|---|---|---|---|---|
| 2,800,682 | * | 7/1957 | Dooley | 68/3 X |
| 3,050,422 | * | 8/1962 | Zak | 134/1 |
| 3,066,084 | * | 11/1962 | Osterman, Jr. et al. | 134/1 X |
| 3,688,527 | * | 9/1972 | Blustain | 68/3 |
| 5,441,062 | * | 8/1995 | Nogues | 134/122 |
| 5,813,134 | * | 9/1998 | Min et al. | 34/255 |

FOREIGN PATENT DOCUMENTS

| | | | | |
|---|---|---|---|---|
| 687970 | * | 2/1953 | (GB) | 68/3 |
| 126258 | * | 5/1994 | (JP) | 134/1 |
| 245465 | * | 11/1969 | (SU) | 134/1 |
| 1831379 | * | 7/1993 | (SU) | 134/1 |

* cited by examiner

*Primary Examiner*—Philip R. Coe
(74) *Attorney, Agent, or Firm*—Klauber & Jackson

(57) ABSTRACT

A process and apparatus for ultrasonic cleaning of materials in which vibrating plates are used in close contact with a material to be cleaned. The material is placed in a shallow liquid and the vibrator of the plates eliminate dirt or contaminating substances from the material by cavitation of the liquid. The vibrating plates are flexurally vibrated at a frequency which correspond to its resonant frequency and is one of a sonic or ultrasonic frequency. The acoustic field created by the oscillation of the plates and in cleaning the material. A pledging system may also include ultrasonic vibrating plates to assist in expelling water.

19 Claims, 4 Drawing Sheets

PROCESS AND DEVICE FOR CONTINUOUS ULTRASONIC WASHING OF TEXTILE

BACKGROUND OF THE INVENTION

1. Field of the Invention

The present invention deals with a method and ultrasonic system for continuous cleaning of solid materials that have a large surface, in the form of sheets or plates, especially flexible materials such as fabrics, plastics, etc.

Ultrasonic energy has been used commercially in industrial cleaning of pieces of rigid materials, especially those that have complex geometries. The cleaning action of high intensity ultrasounds may be mainly attributed to effects related to the phenomenon of acoustic cavitation (formation and implosion of bubbles), such as erosion, agitation and dispersion of the dirt, causing of chemical reactions on the surfaces to be cleaned, penetration of the cleaning solution in pores and cracks, etc.

2. Description of the Related Art

The application of ultrasounds for washing flexible materials and particularly textiles has been tried over the last few years. The strategies have been directed towards the production of cavitation in the entire volume of liquid in which the materials to be cleaned are placed. These systems have not achieved commercial development possibly because they have significant inconveniences. Thus, the use of a large volume of liquid tends to imply a high consumption thereof. On the other hand, it is practically impossible to achieve a homogeneous distribution of the acoustic field in the entire washing volume. This causes a waste of energy (in the areas of low acoustic energy the cavitation threshold is not reached and cleaning does not take place) and causes the washing to be irregular. In order to overcome this situation the washing time must be increased, treatment must be done with a low proportion of material to be washed per volume of liquid and this material must be moved so that it passes through the areas of maximum energy of the washing cavity. Besides, there are other difficulties that come from the gas content in the liquid and from the presence of bubbles between the materials to be washed. In fact, in Spanish patent no. 9401960 good results are only achieved by degassing the liquid so that the concentration of gas is less than 50% of the saturation concentration. Likewise, degassing methods of the washing liquid are proposed in patents EP9320-1142.2 and FR-9304627.

The previous problems have implied practical limitations which, up until now, have hindered the industrial-commercial development of ultrasonic systems for washing of textiles and flexible materials. Nowadays, conventional washing processes in batches that require a significant consumption of water, detergent and energy are used in industrial laundries. Besides the handling system is very elaborate. The continuous washing processes which at times have been tried to be introduced have not been successful due to the low level of cleaning achieved when traditional washing methods have been used.

The process and ultrasonic system that the present invention refers to has some characteristics that manage to solve to a large degree the problems posed by the previous ultrasonic systems, such as the requirement of large volumes of water, the need to agitate the pieces or degassing. At the same time, this process proves to be suitable for continuous treatment thanks to its action being rapid.

SUMMARY OF THE INVENTION

The process that the present invention refers to is based on the use of ultrasonic energy which, as it is known, may be a useful tool to improve and speed up the washing process.

The difference that characterizes this invention is that ultrasonic vibrations are applied to the materials to be washed by means of vibrating plates that are put in direct contact with these materials that have to be submerged in a shallow layer of liquid. This cleaning process may be complemented by immediate rinsing and, once out of the liquid, ultrasonic energy may be applied once again by contact to eliminate an important part of the liquid content in the washed material, producing a predrying effect. Likewise, the invention refers to a device capable of carrying out the described process. This device is especially suitable to treat materials with a large surface, that is to say, in the form of a band, strip or sheet. It is characterized in having the necessary means to apply acoustic energy directly on the materials to be washed, by means of plate-shaped radiators activated by piezoelectric or magnetostrictive exciters. These radiators may be in contact with the materials or very close to them, the contact surface being submerged in the washing liquid. This liquid, which may be any cleaning solution, generally an aqueous based one, does not need to be degassed.

The process object of this patent comprises the following steps: a) wetting the material in a cleaning solution, b) eliminating the dirt or contaminating substances from the material by means of applying high intensity ultrasonic vibrations by vibrating plates in contact with or very close (at least 10 mm) to the material; c) rinsing in a layer of water or clean liquid that may also be aided by ultrasonic vibrations; and d) predrying the material by applying ultrasonic vibrations by contact with the material outside of the liquid.

Elimination of the dirt or of the contaminating substances is produced as a result of exposure of the material to the vibrations (or very close acoustic field) of the large surface plate-shaped ultrasonic radiators. The cleaning effect is so rapid that it permits the material to be cleaned to pass continuously by the vibrating surface (or through its very close acoustic field), at a certain rate, in the range of some cm(s) in such a way that the material occupies the area of the intense acoustic field during a short time.

The large surface vibrating plates oscillate at the excitation frequency that is made to correspond with one of the flexural resonant modes thereof. The very close acoustic field proves to be almost as efficient as the direct vibration itself of the plate because its displacement is proportional to the vibration amplitude of the same.

Although the flexural vibration of the plates implies amplitude maximums and minimums, the homogeneity in the washing effect is achieved by displacing the material in such a way that each part of the material has been exposed during the same total time to areas of intense acoustic field. For example, we can take as an example rectangular plates vibrating flexurally with nodal lines parallel to the longest side and that produce a uniform washing effect on material that slides parallel to or in contact with the surface in the direction marked by the shortest side.

The cleaning solutions to be used may be an aqueous based one with surface active agents which may or may not contain other additives such as enzymes, whiteners, etc.; they may also be non-aqueous based. Besides, the liquid means may have any concentration of dissolved gas.

After the step of eliminating dirt, the material is then rinsed. This rinsing step is, likewise, done in a liquid layer and may also be enhanced by applying ultrasounds in a similar way to the process of eliminating contaminants.

There may be one or several cleaning and rinsing steps. Afterwards and before the conventional drying process, a predrying or dewatering step by means of applying the ultrasonic vibration plates in contact with the material working in air, may be applied. Thus, a process of atomization and pumping of a great deal of the liquid contained in the material towards the outside is produced and this process facilitates the subsequent drying.

Besides the described washing process, a device to carry out the process is also an object of this patent. The device is comprised of:

A washing system or system for eliminating the formed contaminants by at least one plate that vibrates flexurally, excited at ultrasonic frequency in one of its resonant modes and with at least one of its surfaces submerged in the cleaning solution. The shape of the plate may be square, rectangular, circular or any other one. The thickness of the plate may be constant, but it may also have staggered or continuous variations to modify the distribution of amplitudes of displacement of the plate and in general to achieve the desired natural form and frequencies of vibration. Also, in the event that curved surfaces are to be cleaned, the radiant element may have a curvature to adapt to the surfaces to be cleaned. An example is FIG. 5.

The cleaning solution forms a very thin layer in which the surface to be cleaned is submerged and the surface of the radiant element. There are means to replace the liquid.

The radiant ultrasound plate is excited by a piezoelectric or magnetostrictive type vibrator driven by electronic power equipment. The vibrator consists of a transduction element and a mechanical vibration amplifier that may be staggered, conical, catenoid or others. This amplifier directly excites the vibrating plate in the center or at another place or at other places.

The electronic equipment will generally continuously produce a signal with a fixed frequency and amplitude, but operating cycles may be established in which the frequency varies, in order to achieve more uniform results, or in which the amplitude is reduced a lot for some cycles in order to intensify the cavitation in the remaining ones.

The rinsing system may be based on a bath wherein ultrasounds are applied by means of a device similar to the previously described system for eliminating contaminants.

The predrying or dewatering system may also be based on flexurally vibrating ultrasonic plates that will operate in aerial medium, passing the material in contact with the vibrating surface, oriented in such a way that the expelled drops do not deposit on the material once again.

The material conveying system and/or movement system of the ultrasound generator will depend on the material to be treated. In the event of fabrics, it may be based on a system of driving rolls. In the case of loose pieces of textile material, a type of conveyor belt with a system to place the material flat may be used. In the case of essentially unidimensional materials such as threads, cables, etc., a group of them may be treated by making them pass bidimensionally grouped together.

The process object of this patent may require the application of various washing steps with different solutions, or several washing and rinsing cycles.

DETAILED DESCRIPTION OF THE PREFERRED EMBODIMENTS

To provide a better understanding, some figures that show different possibilities of carrying out the process object of the invention are shown in an illustrative and non-restrictive manner.

Figure 1:
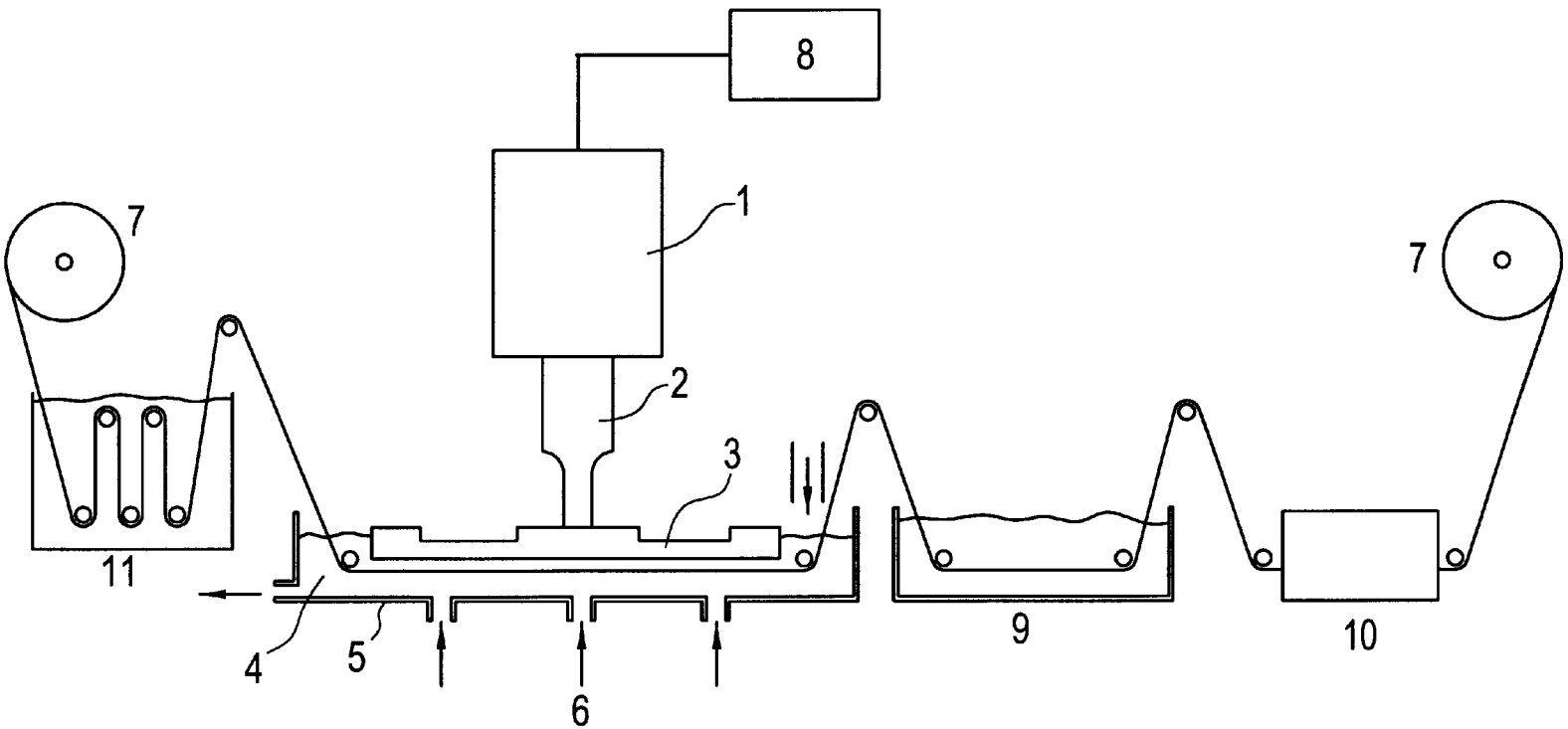
FIG. 1 illustrates a first embodiment of the present invention.

FIG. 1 shows a first embodiment of the invention object of this patent suitable for continuous and flexible materials that are moved from left to right in the drawing. The device to eliminate dirt and contaminants is formed by a vibrating plate ultrasound emitter excited by an electronic power generator (8) that produces a signal with the desired frequency. The conversion of electric energy into mechanical energy takes place in a piezoelectric or magnetostrictive transducer (1). The mechanical energy is transmitted by means of a mechanical amplifier (2) to the radiant element (3). The radiant element has the shape of a rectangular plate with a profile staggered in its rear part and that is partially submerged in the liquid medium (4), that is located in a shallow container (5), less than half the length of the acoustic wave in the liquid. The container has a system (6) in order to replace the liquid. The material is conveyed by a conveyor system (7) in such a way that it passes in contact with or very close to the radiant element (3). Prior to this step the material has passed through a prewetting area (11). After the cleaning step the material is rinsed in a clean water bath (9). The rinsing may be aided by applying an ultrasonic system similar to the one used for cleaning. Finally, the material is rinsed in (10) by means of applying ultrasounds in an aerial medium.

Figure 2:
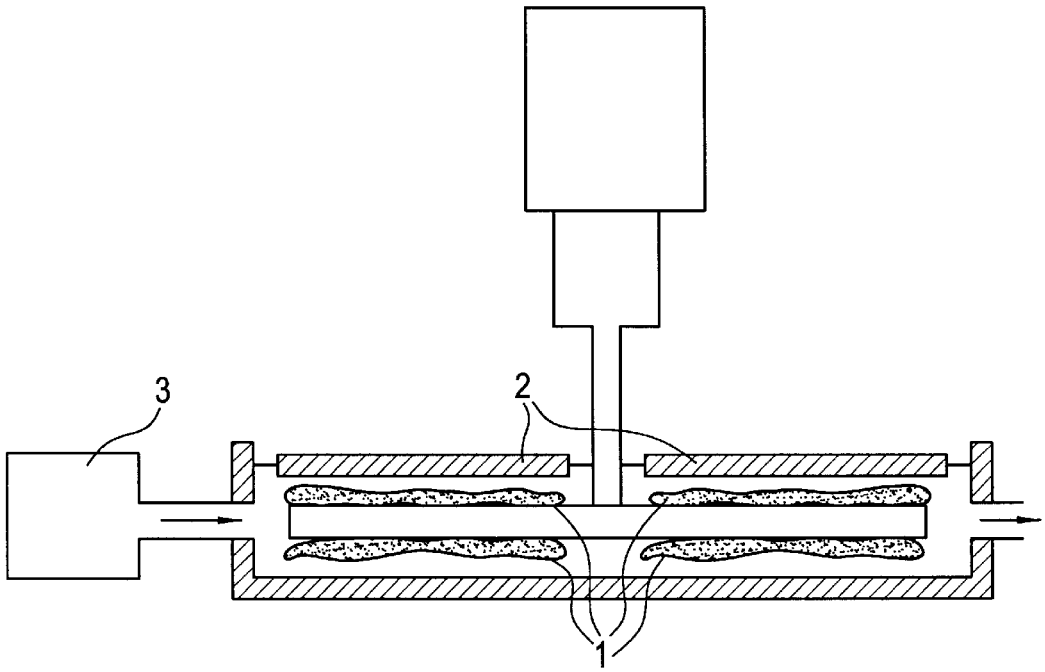
FIG. 2 illustrates an aspect of the present invention wherein two surfaces of a flatpate are used for cleaning.

FIG. 2 is a drawing of another arrangement in which the two surfaces of a flat plate are used. The material to be treated (1) passes in contact with the plate, that is totally submerged, in the normal direction of the plane of the drawing, and it may be subjected to one, two or four passings over the same radiant element. Four independent pieces of material may also be treated simultaneously. The surface of the liquid may be free, in contact with the air, but preferably it is limited by a reflector element (2). Element (3) allows the liquid to be replaced.

Figure 3:
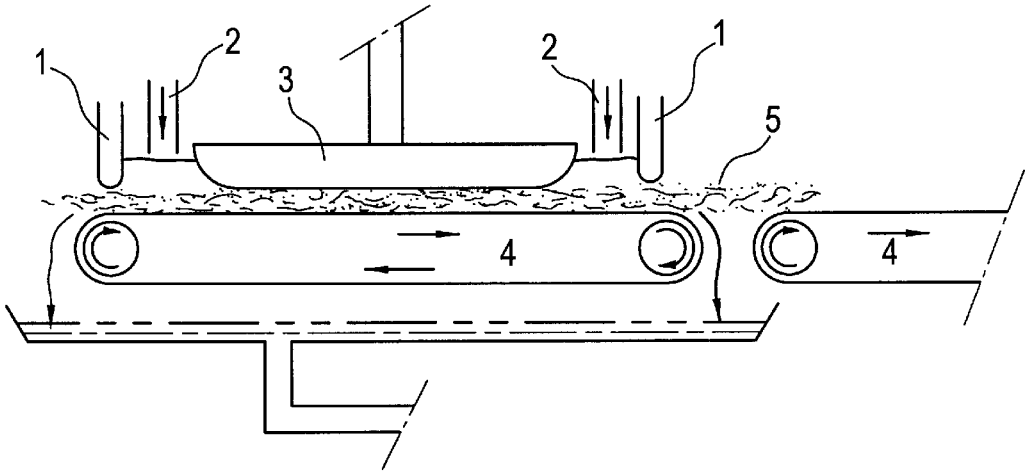
FIG. 3 illustrates another embodiment of the present invention which is more suitable for cleaning thicker material.

FIG. 3 shows a system that is more suitable to treat thicker material (5) and formed by loose pieces that have been spread out and pressed over some conveyor belts or similar conveyor elements (4). There is a continuous flow of washing solution through (2), which allows a constant level of liquid to be maintained. There are some retaining elements (1) that control the flow of liquid that escapes, in such a way that the vibrating plate (3) is partially submerged.

Figure 4A:
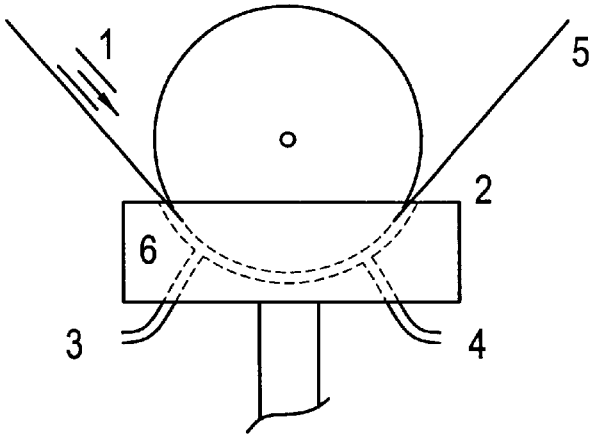
FIG. 4*a* is a side view of the present invention wherein the vibrating plate has a semi-cylindrical surface.
Figure 4B:
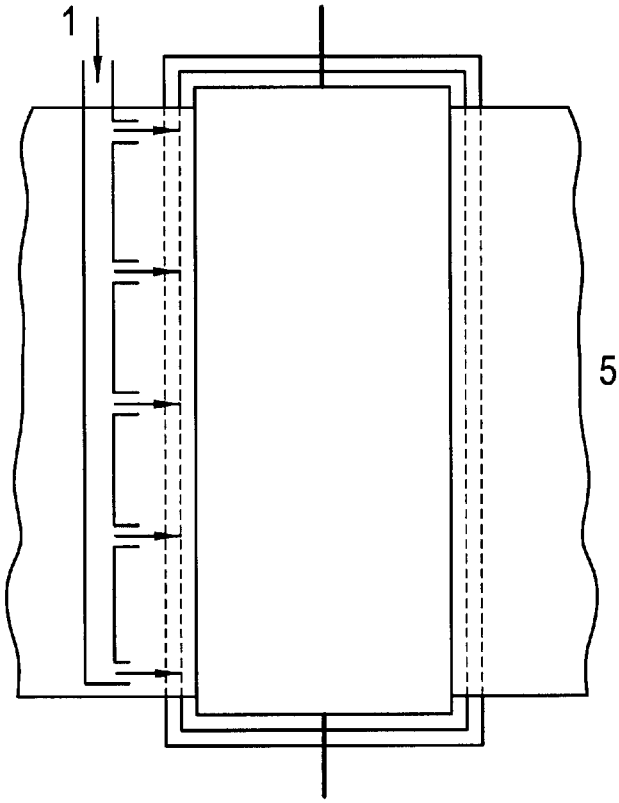
FIG. 4*b* illustrates another embodiment of the present invention adapted for cleaning a material having a cylindrical surface.

FIG. 4 shows a vibrating plate (6) with a semicylindrical cavity in order to be able to contain a layer of liquid that is formed between the plate and a cylinder that acts as a device to convey the material to be cleaned (5). The liquid may be injected through (1) and escape through (2). Holes (3) and (4) in the vibrating plate itself may be used to replace the liquid.

Figure 5:
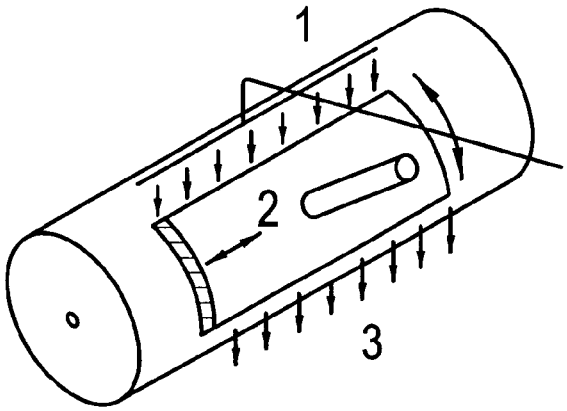
FIG. 5 illustrates another embodiment of the present invention adapted for cleaning a material having a cylindrical surface.

FIG. 5 is a drawing of another possible arrangement. In this case the surface to be cleaned is cylindrical. The thin liquid layer is formed in a dynamic manner by the constant supply of liquid that comes out through (1) and escapes through (3). In this case the vibrating plate (2) is concave and does not cover the entire area to be treated, the plate as well as the liquid supply system being provided with movement such as the one expressed by the arrows so that there is access to the entire surface to be cleaned. The cylinder may also have rotating movement about its axis.

Figure 6:
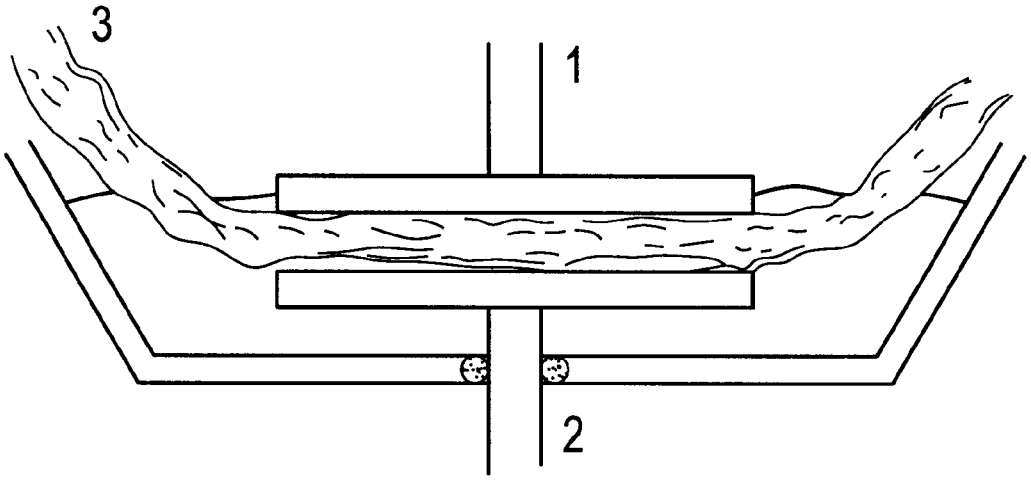
FIG. 6 illustrates an aspect of the present invention wherein two vibrating plates act simultaneously on the material to be cleaned.

FIG. 6 exemplifies the use of more than one plate (1) and (2) acting simultaneously on two sides of the material to be treated (3). The frequency may be the same or different. Different frequencies may be used to achieve more uniform results.

What is clamed is:

1. A process for continuous ultrasonic washing of solid materials arranged in the form of sheets, strips, bands or layers having a large surface, and substantially unidimensional materials grouped together to form a band having a large surface, in a liquid medium, said process comprising:

(a) wetting surfaces of a material to be cleaned, (b) eliminating dirt or contaminating substances from the material to obtain a cleaned material, and (c) rinsing and drying the cleaned material, wherein step (a) includes subjecting the material to be cleaned to a wetting method selected from at least one of (i) submersion in a fine layer of liquid and (ii) applying a fine layer of liquid, and wherein step (b) includes placing the material to be cleaned in approximate contact with at least one vibrating plate, so that the liquid is subjected to cavitation by said at least one vibrating plate, and said at least one vibrating plate is flexurally vibrated at a frequency corresponding to one resonant mode thereof, said frequency being selected from one of high sonic frequencies and ultrasonic frequencies.

2. A process according to claim 1, wherein step (b) includes passing the material to be cleaned through a cleaning system arranged essentially bidimensionally in a form selected from bands, strips, sheets and layers.

3. A process according to claim 1, wherein the liquid is a cleaning solution.

4. A process according to claim 1, wherein step (b) includes providing relative movement between the at least one vibrating plate and the material to be cleaned.

5. A process according to claim 1, wherein step (b) includes conveying the material to be cleaned in a continuous manner along the at least one vibrating plate so that all of the material to be cleaned becomes exposed to vibrations generated by the at least one vibrating plates for a similar amount of time.

6. A process according to claim 5, wherein the vibrations are simultaneously applied by several vibrating plates.

7. A process according to claim 1, wherein the rinsing in step (e) includes treating the cleaned material with vibrations produced by the at least one vibrating plate that vibrates flexurally at a frequency corresponding to a resonant mode thereof, said frequency being selected from high sonic frequencies and ultrasonic frequencies.

8. A process according to claim 1, further comprising a predrying step after the eliminating recited in step (b), said predrying step comprising applying to the cleaned material an ultrasonic vibration of at least one vibrating plate radiating in air and contacting the cleaned material with a vibrating surface of said vibrating plate.

9. A device for continuous ultrasonic washing of solid materials arranged in the form of sheets, strips, bands or layers having a large surface and unidimensional materials grouped together to form a band having a large surface, in a liquid medium, said device comprising:

a dirt eliminating area for a material to be cleaned, at least one rinsing area for the cleaned material, and a drying area, at least one vibrating plate arranged in said dirt eliminating area, and wetting means arranged in said dirt eliminating area for wetting the material to be cleaned by a method selected from at least one of (i) submerging the material to be cleaned in a fine layer of liquid medium, and (ii) covering the material to be cleaned by the fine layer of liquid medium, said at least one vibrating plate being arranged in a position which is is in approximate contact with said material to be cleaned, wherein said at least one vibrating plate is arranged to vibrate flexurally at a frequency corresponding to a resonant mode thereof, said frequency being selected from high sonic frequencies and ultrasonic frequencies, whereby said liquid medium is subjected to cavitation.

10. A device according to claim 9, further comprising means for producing a vibration of said at least one vibrating plate acting on the material to be cleaned, said means being selected from the group consisting of (i) piezoelectric transducers and (ii) magnetostrictive transducers excited at least one electronic generator.

11. A device according to either of claim 9 or 10, wherein the device is arranged to permit relative movement between said at least one vibrating plate and the material to be cleaned.

12. A device according to claim 9, further comprising means for permitting the liquid medium to be replaced, said means including said at least one vibrating having holes.

13. A device according to claim 9, wherein, in the rinsing area, said at least one vibrating plate vibrates at a frequency corresponding to a resonant mode thereof, said frequency being, selected from high sonic frequencies and ultrasonic frequencies.

14. A device according to claim 9, wherein, in the drying area, at least one ultrasound generator is arranged for predrying the cleaned material, said ultrasound generator comprising at least one vibrating plate vibrating at a frequency corresponding to a resonant mode thereof, said frequency being selected from high sonic frequencies and ultrasonic frequencies, so that the cleaned material to be predried is arranged to pass in contact with said at least one vibrating plate.

15. A device according to claim 9, further comprising a prewetting area for prewetting the material to be cleaned, the prewetting area being located before said dirt eliminating area.

16. A device according to claim 9, for cleaning materials to be cleaned selected from textiles, fabrics, plastics, threads grouped together to form a band having a large surface, and cables grouped together to form a band having a large surface.

17. A device according to claim 9, wherein said at least one vibrating plate is arranged in a position at which it is in contact with said material to be cleaned.

18. A process according to claim 1, wherein the material to be cleaned is selected from the group consisting of textiles, fabrics, plastics, threads grouped together to form a band having a large surface, and cables grouped together to form a band having a large surface.

19. A process according to claim 1, wherein said material to be cleaned is in contact with said at least one vibrating plate.

* * * * *